US007147393B2

(12) United States Patent
Yoon

(10) Patent No.: US 7,147,393 B2
(45) Date of Patent: Dec. 12, 2006

(54) STICK-TYPE GLUE DISPENSER WITH QUICK-OPENING CAP

(75) Inventor: Hyun-son Yoon, Seoul (KR)

(73) Assignee: Morris Corporation, Ichon-shi (KR)

( * ) Notice: Subject to any disclaimer, the term of this patent is extended or adjusted under 35 U.S.C. 154(b) by 286 days.

(21) Appl. No.: 10/839,928

(22) Filed: May 5, 2004

(65) Prior Publication Data

US 2005/0082318 A1 Apr. 21, 2005

(51) Int. Cl.

| | |
|---|---|
| ***B43K 23/00*** | (2006.01) |
| ***B43K 23/02*** | (2006.01) |
| ***B43K 5/00*** | (2006.01) |
| ***B43M 11/06*** | (2006.01) |
| ***B65B 43/38*** | (2006.01) |

(52) U.S. Cl. ..... 401/98; 401/131; 401/202; 401/183; 215/295

(58) Field of Classification Search ..... 401/98, 401/131, 171, 175, 202, 213, 243, 262, 269, 401/183; 215/295

See application file for complete search history.

(56) References Cited

U.S. PATENT DOCUMENTS 1,481,443 A * 1/1924 Stone ..... 215/233
3,817,426 A * 6/1974 Fooks ..... 222/105
5,975,783 A * 11/1999 Hu ..... 401/245

* cited by examiner

*Primary Examiner*—David J. Walczak
(74) *Attorney, Agent, or Firm*—Intellectual Property Law Group LLP; Otto O. Lee; Juneko Jackson

(57) ABSTRACT

A stick-type glue dispenser for dispensing solid or liquid glue content, which allows a cap to be easily separated from the glue dispenser by a simple operation. The glue dispenser includes an inner tube, an outer tube coupled to the inner tube at an upper end thereof in such a way to allow a lower end of the outer tube to be pressed radially inward, and a cap coupled to a lower end of the inner tube, with an upper end of the cap having a slant face. The cap is separated from the inner tube by a sliding contact between the lower end of the outer tube and the slant face of the cap when a lower part of the outer tube is pressed raidally inward. In one embodiment, the inner tube contains a holder for holding solid glue content. The holder is threadedly coupled to a screw which passes through the inner tube, thereby enabling the holder to move the solid liquid content in the inner tube by rotating the screw. In another embodiment, the inner tube contains liquid glue content therein. The inner tube is provided at its lower end with a tip member serving as an outlet for the liquid glue content. The cap may be provided at its bottom surface with a mount plate to easily store the glue dispenser in an erect posture.

22 Claims, 13 Drawing Sheets

A–A'

B–B'

STICK-TYPE GLUE DISPENSER WITH QUICK-OPENING CAP

BACKGROUND OF THE INVENTION

1. Field of the Invention

The present invention relates to a stick-type glue dispenser including a cap, which is easily separated from the stick-type glue dispenser by a simple operation.

2. Description of the Prior Art

In general, stick-type glue dispensers may be classified into the following: a stick-type glue dispenser for dispensing solid glue content and a stick-type glue dispenser for dispensing liquid glue content.

The stick-type glue dispenser for dispensing solid glue content is typically constructed such that the solid glue content can be projected from and retracted into the glue dispenser, i.e., the solid glue content can be moved up and down in a tube of the stick-type glue dispenser. In the stick-type glue dispenser adapted to dispense solid glue content which is to be projected and retracted, a holder for holding the solid glue content is movably disposed up and down in a tube. To move the solid glue content up and down, a screw is threadedly engaged with a central threaded hole of the holder. A rotator is integrally coupled to the screw to rotate the screw. Consequently, when the rotator is rotated, the screw threadedly engaged with the holder is also rotated, thereby moving the holder up and down in the tube. The conversion of the rotational movement of the rotator into the linear movement of the holder is of course achieved by linear guide grooves formed on the holder which are engaged with linear guide protrusions formed on an inner surface of the tube. According to the stick-type glue dispenser for dispensing solid glue content that is constructed in the above-described manner, the solid glue content can be projected from the glue dispenser by a desired length when necessary. The solid glue content that is projected from the glue dispenser can be retracted into the glue dispenser when it is not necessary to use the glue dispenser any longer.

Meanwhile, the stick-type glue dispenser for dispensing liquid glue content is constructed such that the liquid glue content that is contained in a tube is released by pressing the tube. In this case, the tube is commonly made of soft material such as flexible plastic for convenience in use.

In any of the stick-type glue dispensers for dispensing solid glue content and the stick-type glue dispensers for dispensing liquid glue content, the stick-type glue dispenser essentially requires a cap in addition to the above-mentioned components, which is detachably coupled to a lower end of the tube. Because a considerable amount of moisture is contained not only in the liquid glue content but also in the solid glue content, the amount of moisture that is evaporated from the glue content is gradually increased as the amount of time the glue content is exposed to the ambient air is increased. Due to the evaporation of moisture, the adhesive properties of the glue content is proportionally deteriorated. Accordingly, the cap is necessary to prevent moisture from evaporating from the glue content when the stick-type glue dispenser is not in use.

In a conventional stick-type glue dispenser for dispensing solid glue content, in order to use the stick-type glue dispenser it is necessary for a user to separate the cap from the stick-type glue dispenser with one hand while grasping the glue dispenser body with the other hand.

In this case, if the user is already holding an object to be applied with the glue content with one hand, there is considerable inconvenience in using the stick-type glue dispenser.

SUMMARY OF THE INVENTION

Accordingly, the present invention has been made keeping in mind the above problems occurring in the prior art, and an object of the present invention is to provide a stick-type glue dispenser that is designed to allow the cap to be easily separated from the glue dispenser with only one of the user's hands in a simple manner.

In order to accomplish the above object, the present invention provides a stick-type glue dispenser for dispensing solid glue content and a stick-type glue dispenser for dispensing liquid glue content, in which caps are separated from the glue dispensers by a simple operation.

In one aspect, the present invention provides a stick-type glue dispenser for dispensing solid glue content, which includes (a) a screw, (b) an upper rotatable cap joined to the screw, (c) an inner tube detachably coupled at an upper end thereof to the upper rotatable cap, (d) a glue holder slidably disposed in the inner tube and having a threaded hole with which the screw is engaged, the glue holder being adapted to hold the solid glue content mounted thereon, (e) an outer tube to surround the inner tube such that a gap is defined between a lower part of the inner tube and a lower part of the outer tube and is opened at lower ends of the inner and outer tubes, and (f) a lower cap removably coupled to the lower end of the inner tube such that an upper end of the lower cap is positioned in the gap defined between the lower end of the inner tube and the lower end of the outer tube, the upper end of the lower cap having a slant face, whereby the lower cap is separated from the inner tube by a sliding contact between the lower end of the outer tube and the slant face of the lower cap when a lower part of the outer tube is pressed radially inward.

According to this aspect of the present invention, the stick-type glue dispenser allows the lower cap to be easily and quickly separated therefrom by a simple operation. More specifically, when the lower end of the outer tube is pressed radially inward by a user's fingers, the upper slant end of the lower cap is pushed downward by the lower end of the outer tube, thereby causing the lower cap to be separated from the inner tube.

In the stick-type glue dispenser according to this aspect, the outer tube is preferably provided with at least one slit having a predetermined length. Preferably there are four slits, which are spaced at regular intervals. The slits permit the lower end of the outer tube to be pressed radially inward by a slight force, so that a pushing force from the lower end of the outer tube can be easily applied to the upper slant face of the lower cap.

In another embodiment of the present invention, where the outer tube is made of flexible material, the stick-type glue dispenser may achieve the same effect as that achieved by the slits.

According to another embodiment, the outer tube may be provided at its center with a flat or recess area having a predetermined size to prevent the stick-type glue dispenser from rolling.

In still another embodiment, the lower cap is preferably provided with a mount plate attached to an outer bottom surface thereof. Where the mount plate is attached to the outer bottom surface of the lower cap, the stick-type glue dispenser can be easily erected, thereby enhancing convenience in storage. In another embodiment, when the lower cap is separated from the inner tube in order to use the stick-type glue dispenser, the lower cap remains at the place where the lower cap was separated, thereby enhancing convenience in use.

In yet another embodiment of the present invention, the stick-type glue dispenser, it is preferable that the upper rotatable cap is formed into a hemispherical shape, the outer tube is enlarged downward such that a diameter of the lower end of the outer tube is larger than that of the upper end of the outer tube, and the lower cap has an outer bottom surface which is flattened. By such a configuration, even if there is no mount plate on the lower cap, it is possible to achieve the same effect as that achieved by having the mount plate. Since the center of mass of the stick-type glue dispenser is lowered as the solid glue content is consumed, the stability of the stick-type glue dispenser in an erect posture is increased as the glue content is consumed. Accordingly, the stick-type glue dispenser according to this embodiment can be easily erected, and the stick-type glue dispenser can be erected in a posture in which only the outer bottom surface is in contact with a storing surface, thereby enhancing convenience in storage. Where the outer bottom surface of the lower cap is flattened without providing a mount plate, convenience in use is enhanced even though convenience in storage is decreased, as compared to having the lower cap with the mount plate.

In the stick-type glue dispenser according to still another embodiment, the lower cap is preferably provided at its inner bottom surface with convexities or continuous protrusions. Where the stick-type glue dispenser includes the above convexities or protrusions, there is a reduction in a contact area between the solid glue content and the inner bottom surface of the lower cap. Consequently, as the contact area between the solid glue content and the lower cap is reduced, the adhesive force acting therebetween is reduced, thereby allowing the lower cap to be more easily separated from the inner tube. Where the stick-type glue dispenser includes the continuous protrusions, it is preferable that the continuous protrusions are concentrically-arranged circular protrusions.

In another embodiment of the present invention, the stick-type glue dispenser, it is preferable that an outer surface of the inner tube is tapered downward at a region where the inner tube is fitted in the lower cap, and an internal diameter of the lower cap is enlarged upward. By such a configuration, friction between the inner tube and the lower cap is reduced, compared to a case in which the outer surface of the inner tube and the inner surface of the lower cap are of cylindrical shape, thereby allowing the lower cap to be more easily separated from the inner tube.

In yet another embodiment, the present invention provides a stick-type glue dispenser for dispensing liquid glue content, which includes: (a) an inner tube containing liquid glue content therein, (b) a tip member coupled to a lower end of the inner tube to release the liquid glue content contained in the inner tube, (c) an outer tube surrounding the inner tube with an opened gap defined therebetween, and (d) a lower cap removably coupled to the lower end of the inner tube such that an upper end of the lower cap is positioned in the gap defined between the lower end of the inner tube and the lower end of the outer tube, the upper end of the lower cap having a slanted face.

According to still another embodiment of the present invention, the stick-type glue dispenser allows the lower cap to be easily separated from the inner tube by a sliding contact between the lower end of the outer tube and the slant face of the lower cap when a lower part of the outer tube is pressed radially inward, as in the stick-type glue dispenser containing solid glue content according to a previous embodiment.

The stick-type glue dispenser containing liquid glue content according to this embodiment may adopt most components of the stick-type glue dispenser for dispensing solid glue content according to previous embodiments, in order to achieve similar effects by the components.

In the stick-type glue dispenser according to another embodiment, the lower part of the outer tube is preferably provided with at least one slit having a predetermined length. Preferably there are four slits, which are spaced at regular intervals. The outer tube may also be made of a flexible material. The outer tube is preferably provided at its center with a flat or recess area having a predetermined size. The lower cap is preferably provided with a mount plate attached to an outer bottom surface thereof. It is preferable that the upper rotatable cap is formed into a hemispherical shape at its upper part, the outer tube is enlarged downward such that a diameter of the lower end of the outer tube is larger than that of the upper end of the outer tube, and the lower cap has an outer bottom surface which is flat. The lower cap is preferably provided at its inner bottom surface with convexities or continuous protrusions. It is preferable that an outer surface of the inner tube is tapered downward at a region where the inner tube is fitted in the lower cap, and an internal diameter of the lower cap is enlarged upward.

In the stick-type glue dispenser according to yet another embodiment, the inner tube is preferably made of a flexible material. Consequently, the inner tube is easily pressed by a user's hand, and thus the liquid glue content contained in the inner tube is easily released from the inner tube through the tip member, thereby enhancing convenience in use.

In still another embodiment of the stick-type glue dispenser, it is preferable that the tip member includes a lower end serving as an outlet for the liquid glue content, and the lower end of the tip member is projected from and retracted into the tip member by elasticity, in order to assure easy release of the liquid glue content.

BRIEF DESCRIPTION OF THE DRAWINGS

The above and other objects, features and advantages of various embodiments of the present invention will be more clearly understood from the following detailed description taken in conjunction with the accompanying drawings, in which.

DETAILED DESCRIPTION OF SPECIFIC EMBODIMENTS

The embodiments of the present invention will be described in further detail by way of example with reference to the accompanying drawings.

Figure 1:
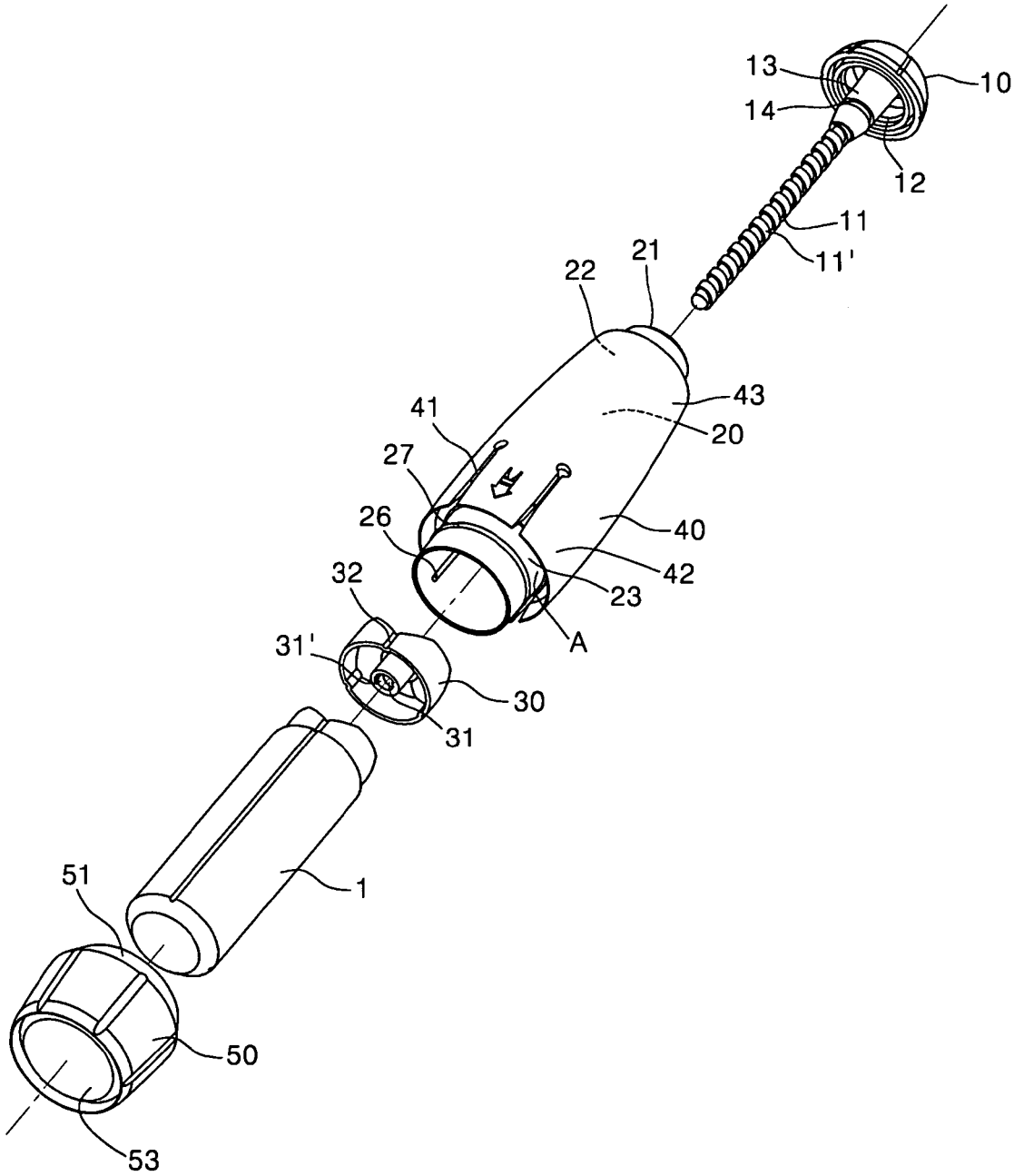
FIG. 1 is an exploded perspective view of the stick-type glue dispenser for dispensing solid glue content, according to one embodiment of the present invention.
Figure 2:
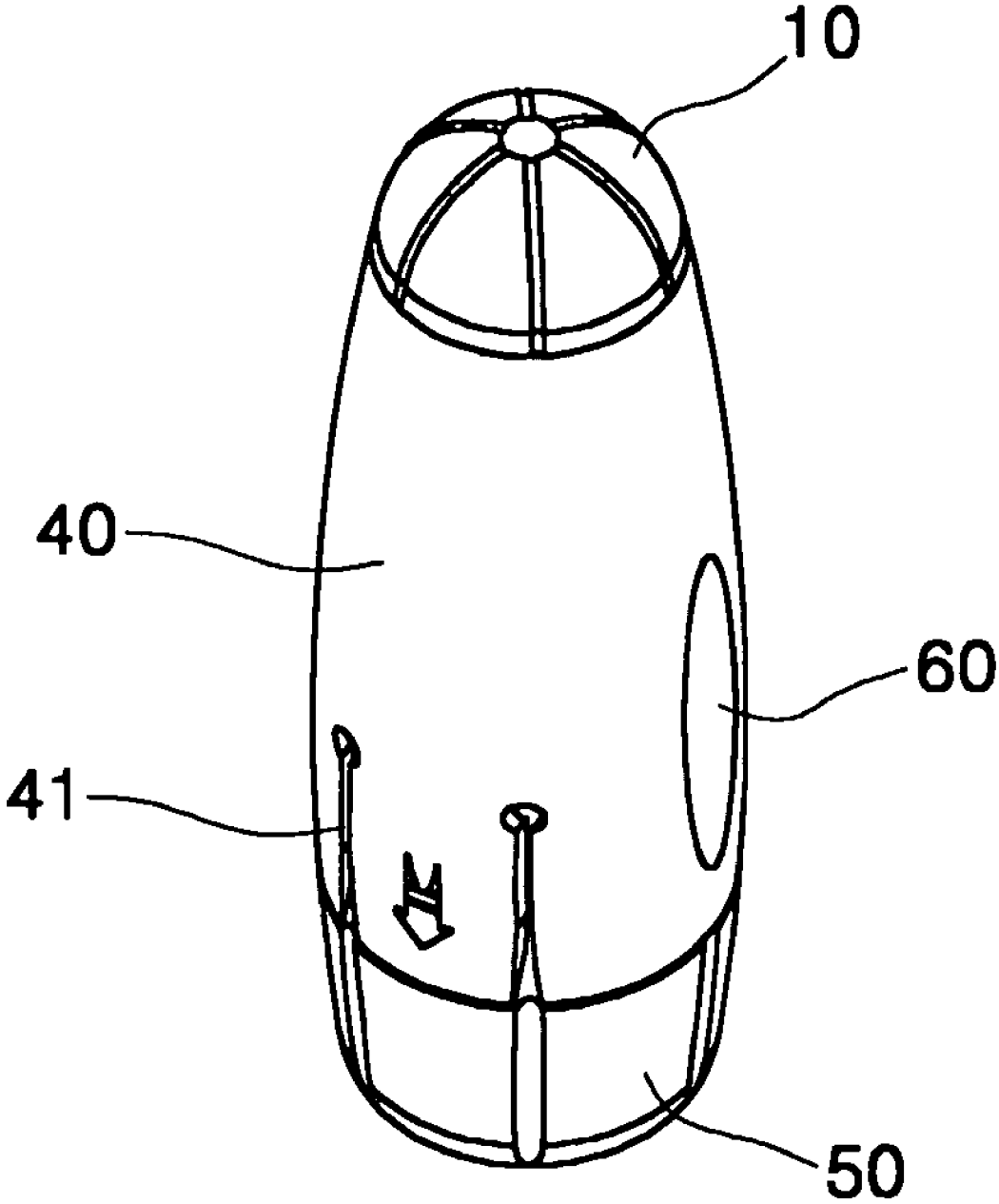
FIG. 2 is a perspective view of the stick-type glue dispenser according one embodiment of to the present invention.
Figure 3:
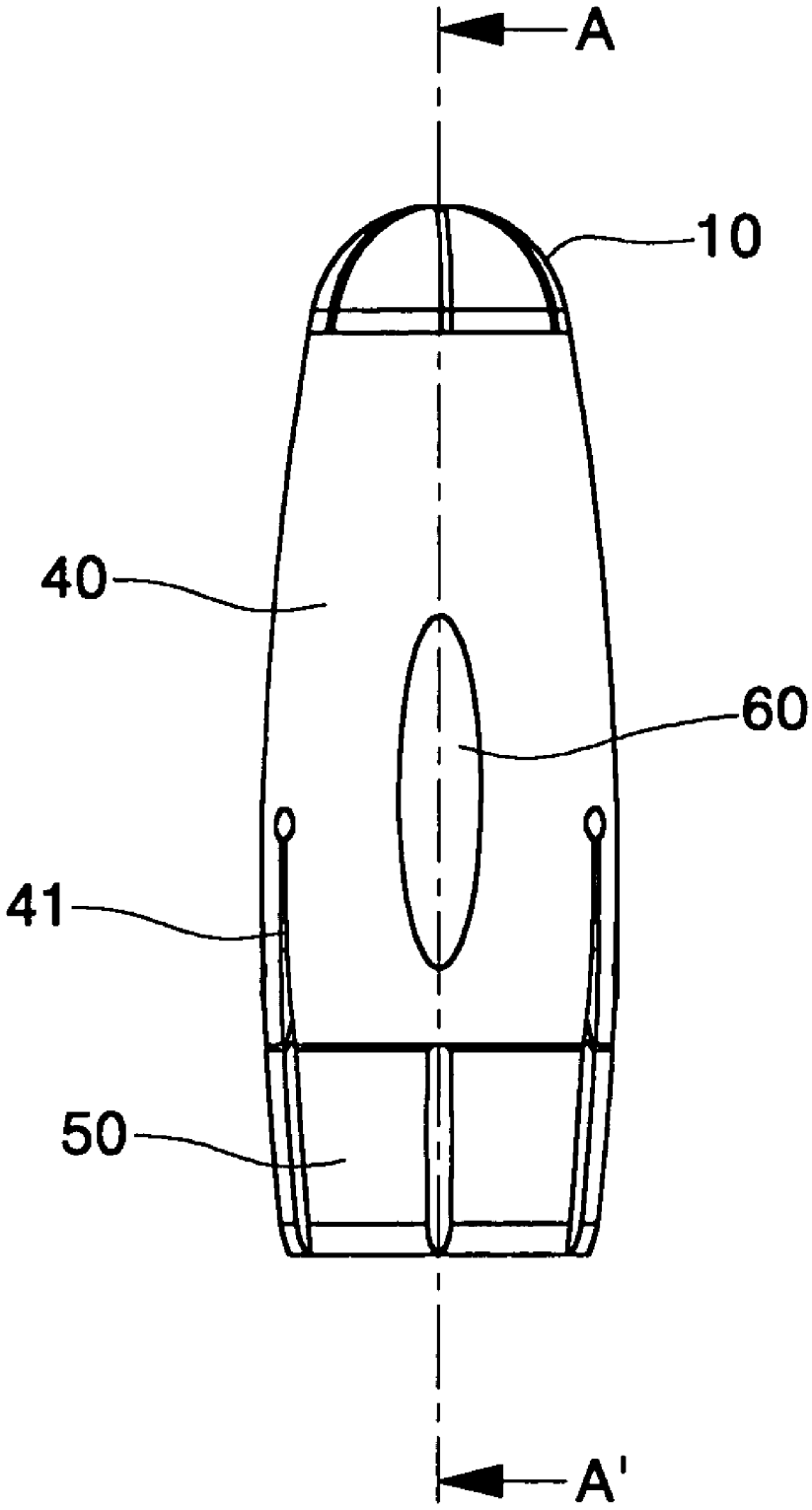
FIG. 3 is a side elevation view of the stick-type glue dispenser according to one embodiment of the present invention.
Figure 4:
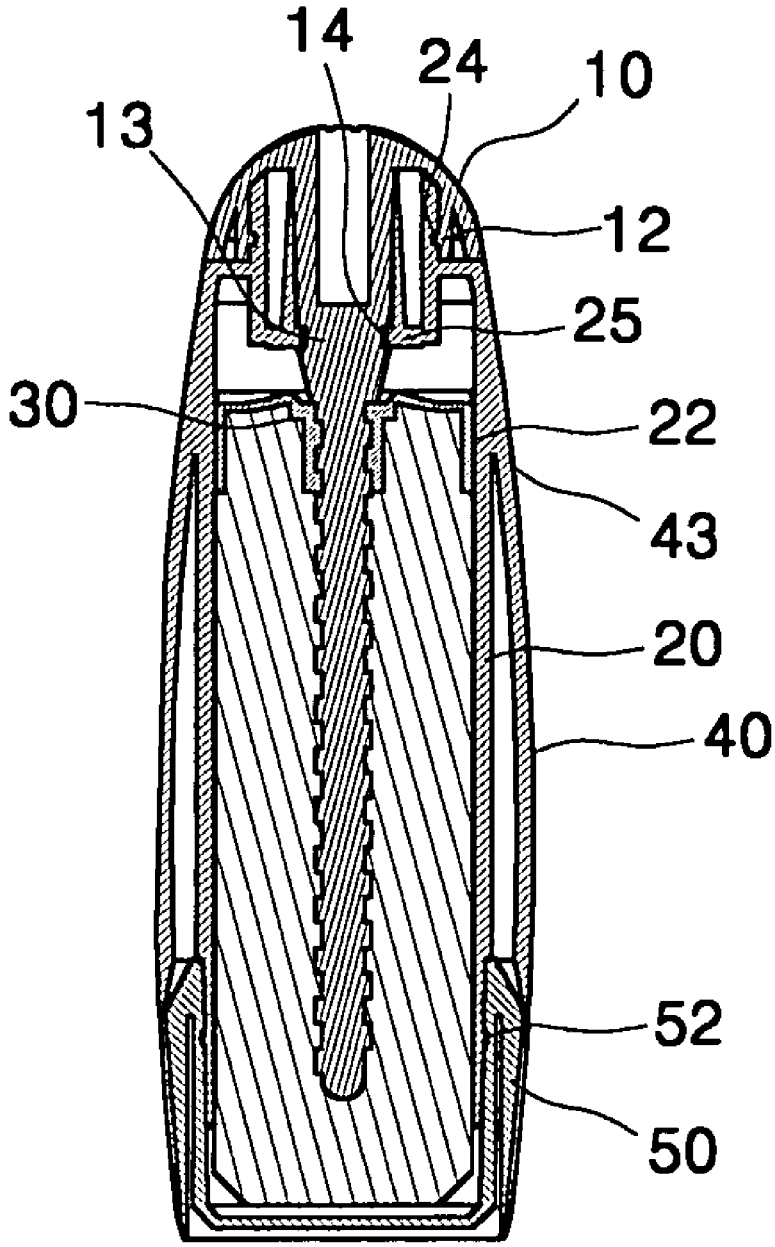
FIG. 4 is a cross-sectional view taken along the line A–A' of FIG. 3.
Figure 5:
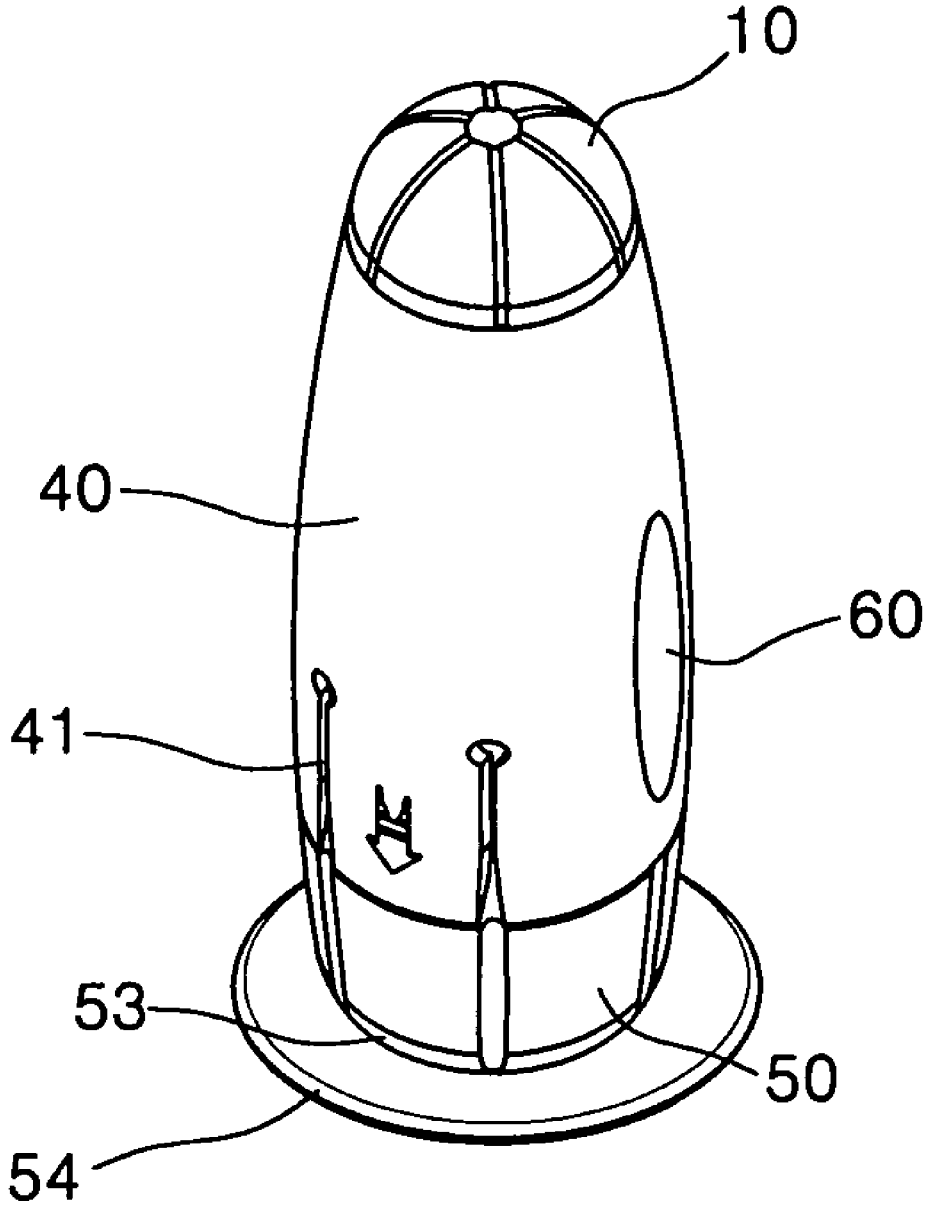
FIG. 5 is a perspective view of the stick-type glue dispenser according to one embodiment of the present invention, which includes a mount plate.
Figure 6:
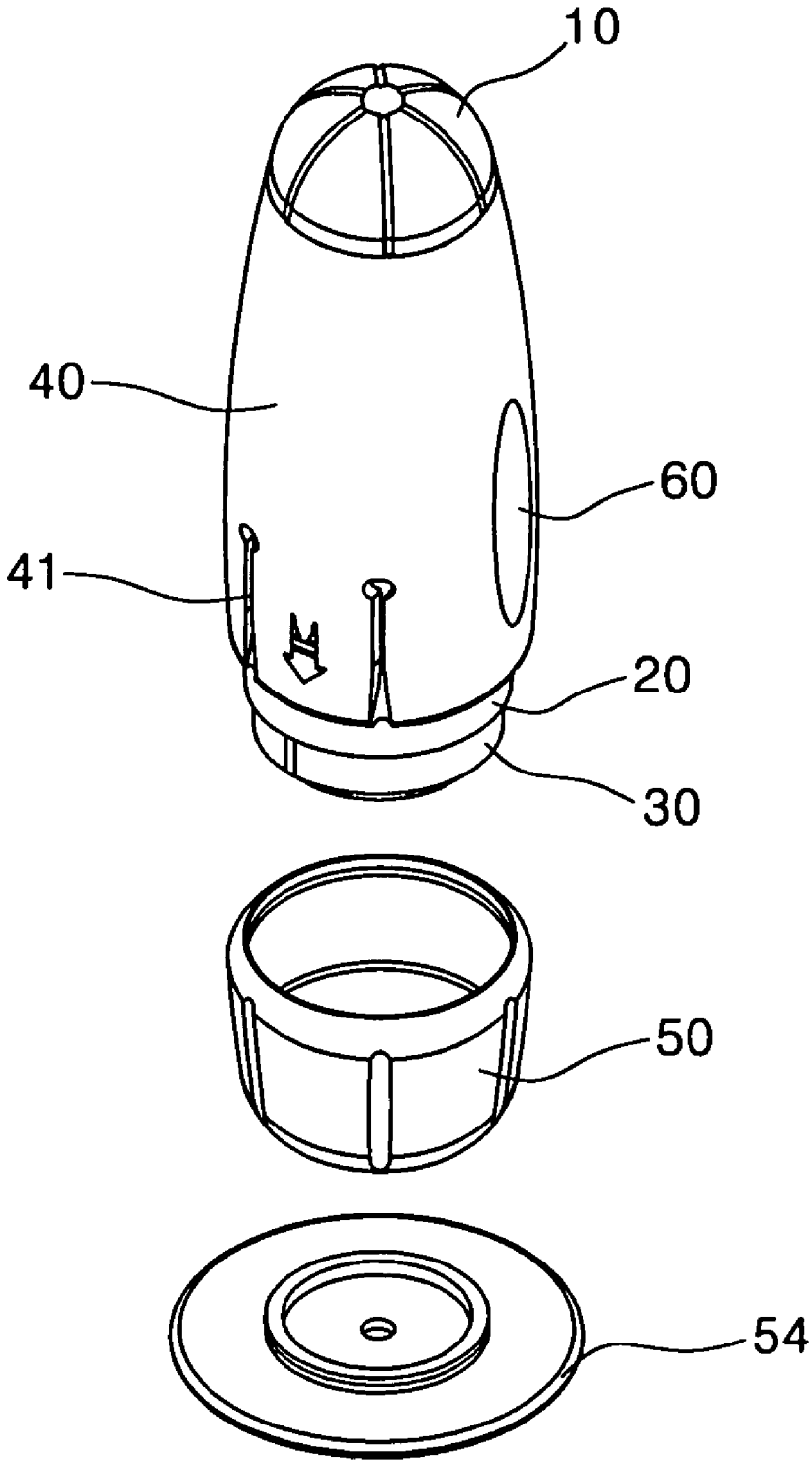
FIG. 6 is an exploded perspective view of the stick-type glue dispenser according one embodiment of to the present invention, which includes a mount plate.
Figure 7A:
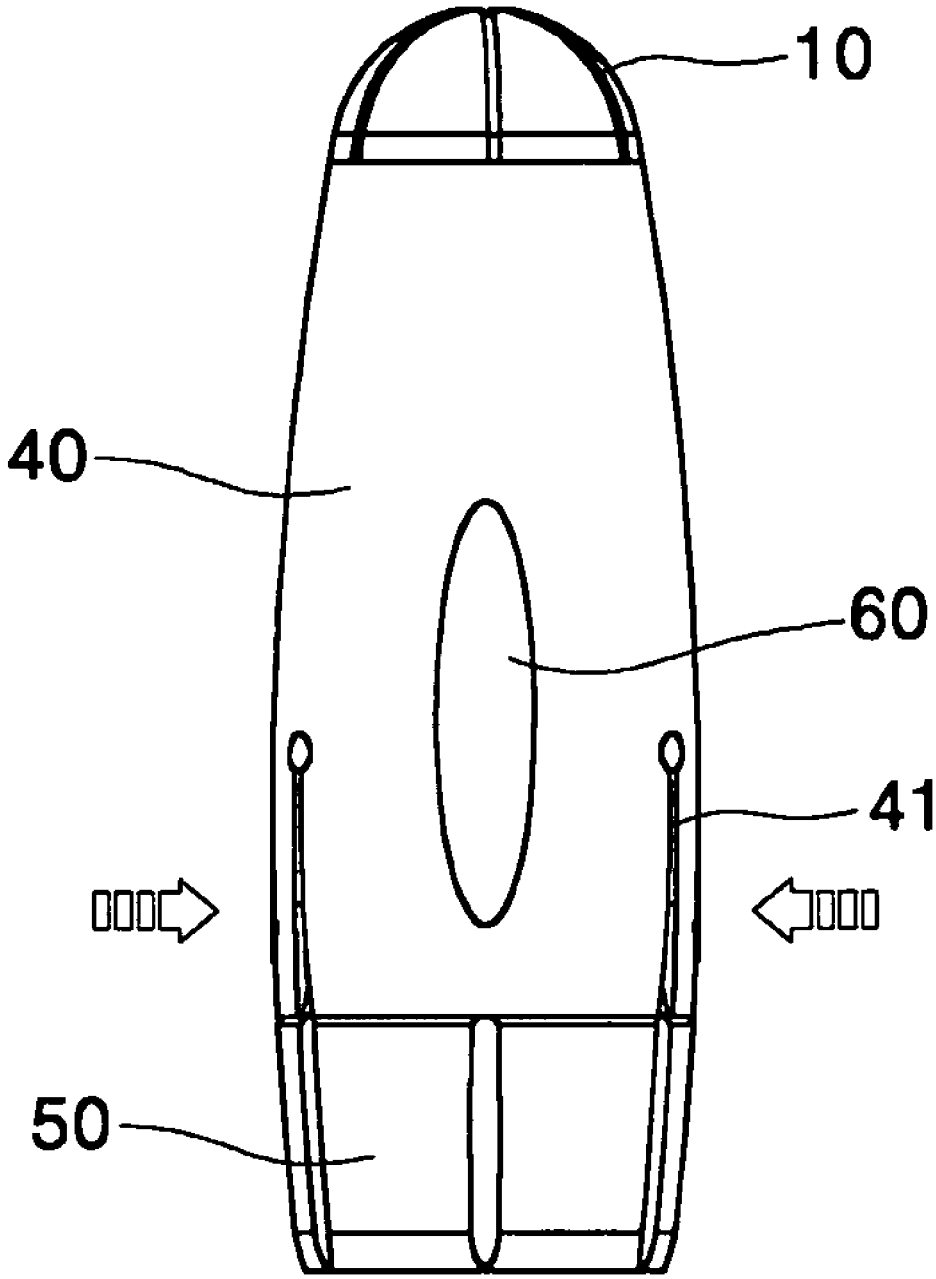
FIGS. 7A and 7B are side elevation views showing an operation of the stick-type glue dispenser according to one embodiment of the present invention.
Figure 7B:
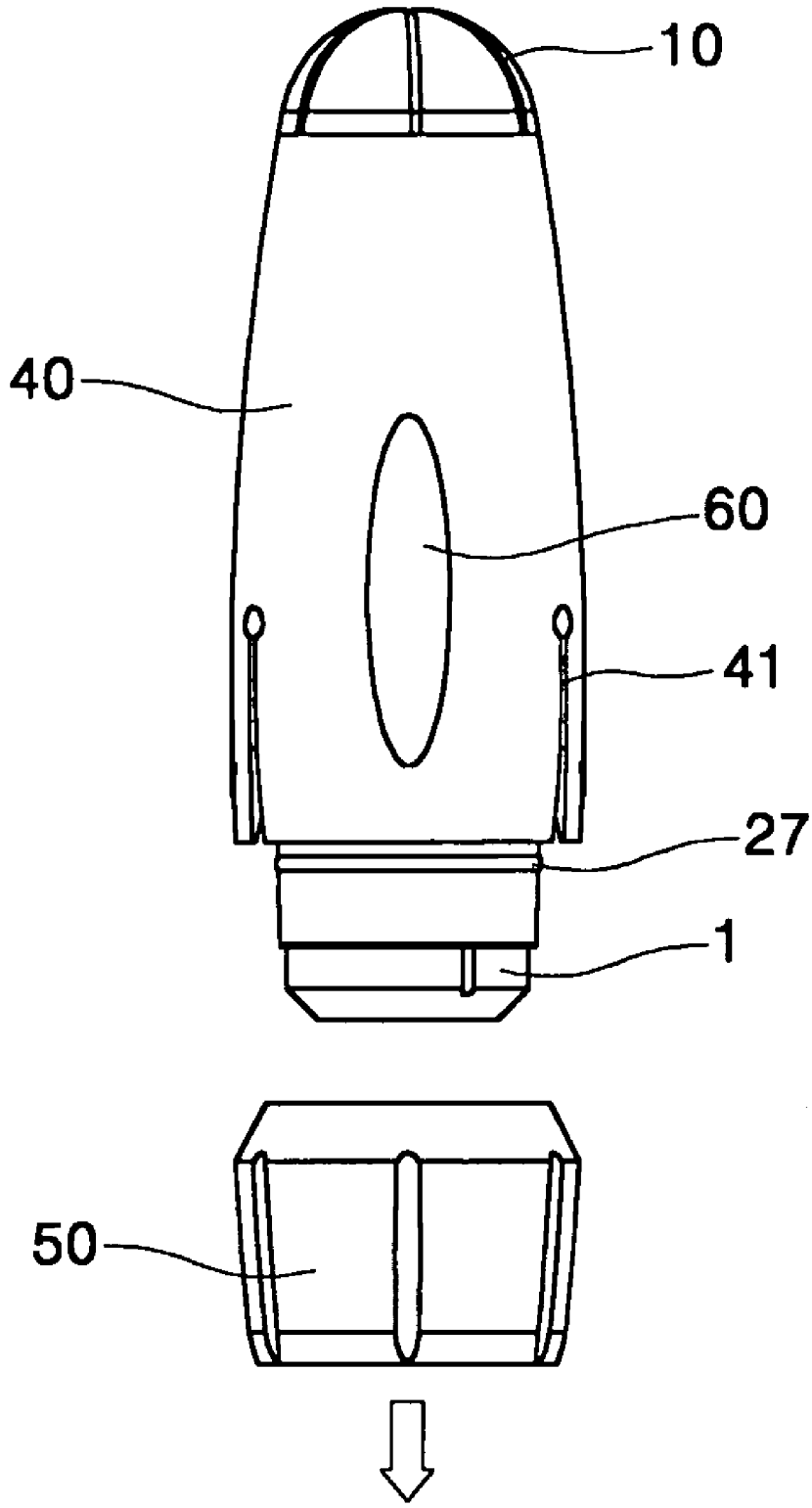
Figure 8A:
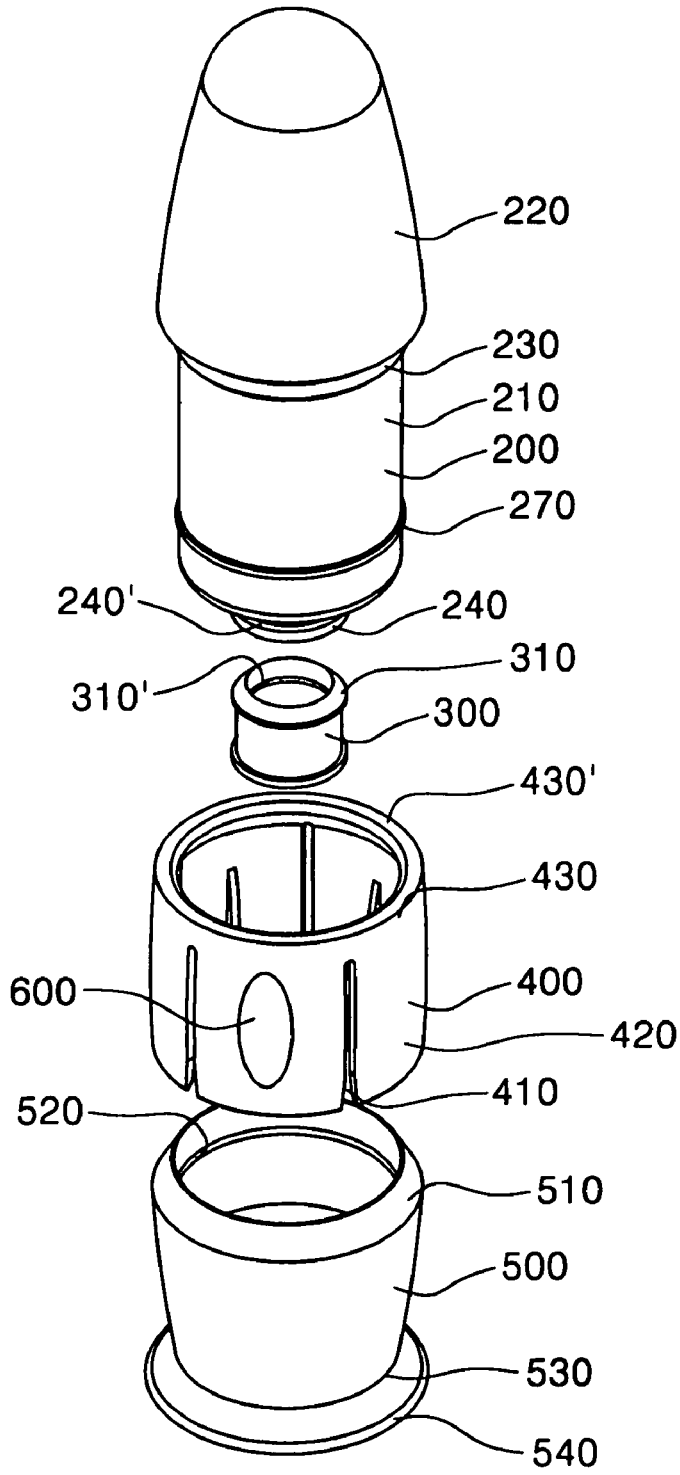
FIG. 8A is an exploded perspective view of the stick-type glue dispenser for dispensing the liquid glue content, according to another embodiment of the present invention.
Figure 8B:
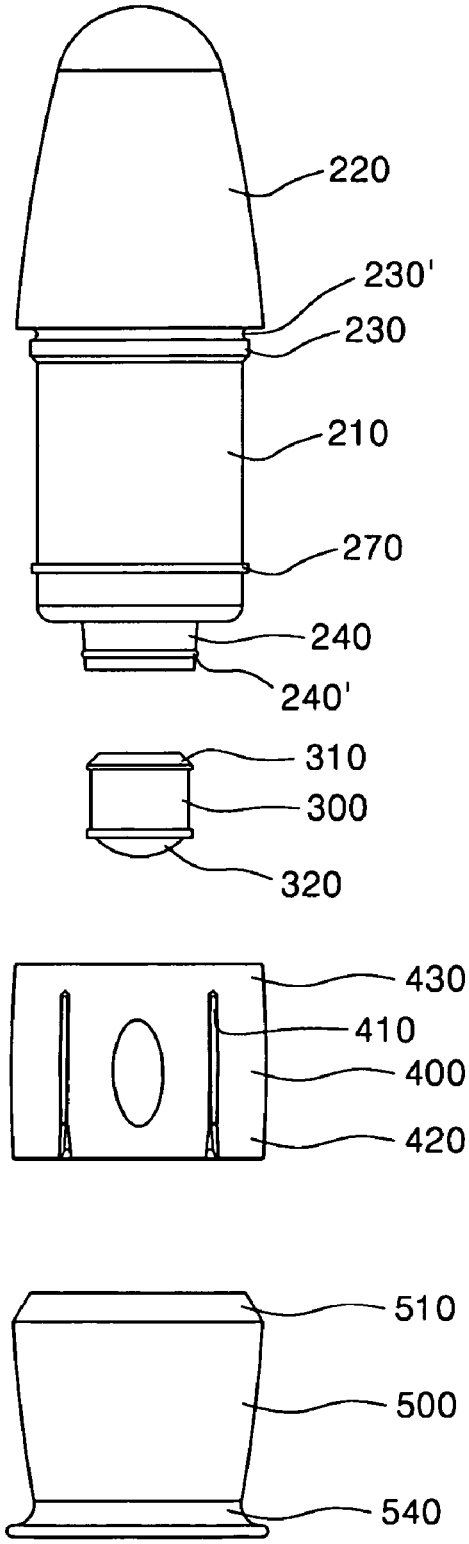
FIG. 8B is an exploded elevation view of the stick-type glue dispenser for dispensing the liquid glue content, according to another embodiment of the present invention.

The present invention is directed to a stick-type glue dispenser for dispensing solid glue content. FIGS. 1 through 7 show a stick-type glue dispenser for dispensing solid glue content according to one embodiment of the present invention. In the drawings, FIG. 1 is an exploded perspective view of the stick-type glue dispenser for dispensing solid glue content, according to one embodiment of the present invention; FIG. 2 is a perspective view of the stick-type glue dispenser according to one embodiment of the present invention; FIG. 3 is a side elevation view of the stick-type glue dispenser according to one embodiment of the present invention; FIG. 4 is a cross-sectional view taken along the line A–A' of FIG. 3; FIG. 5 is a perspective view of the stick-type glue dispenser according to one embodiment of the present invention, which includes a mount plate; FIG. 6 is an exploded perspective view of the stick-type glue dispenser according to one embodiment of the present invention, which includes a mount plate; and FIGS. 7A and 7B are side elevation views showing an operation of the stick-type glue dispenser according to one embodiment of the present invention.

As shown in FIGS. 1 through 4, the stick-type glue dispenser for dispensing solid glue content, according to one embodiment of the present invention, includes an upper rotatable cap 10, an inner tube 20 detachably coupled to the upper rotatable cap 10, a glue holder 30 disposed in the inner tube 20 to move solid glue content 1 up and down, an outer tube 40 surrounding the inner tube 20 with a gap "A" therebetween and having a plurality of slits 41 each having a predetermined length, and a lower cap 50 which is provided at its upper end 51 with a slant face positioned in the gap "A" defined between the inner tube 20 and the outer tube 40.

In the stick-type glue dispenser according to one embodiment, the upper rotatable cap 10 is formed into a hemispherical shape. A screw 11, which is formed at its outer surface with a threaded protrusion 11', is fixedly coupled to the upper rotatable cap 10. Since the screw 11 is fixedly coupled to the upper rotatable cap 10, the screw 11 is rotated together with the upper rotatable cap 10 when the upper rotatable cap 10 is rotated.

The screw 11, which is fixedly coupled to the upper rotatable cap 10, penetrates an upper end 21 of the inner tube 20. The upper rotatable cap 10 is coupled to the upper end 21 of the inner tube 20 in such a way that an annular retaining protrusion 12 formed on an inner surface of the upper rotatable cap 10 is engaged with an annular groove formed on an outer surface of the upper end 21 of the inner tube 20 (see FIG. 4). A connecting stem 13 is provided between the screw 11 and the upper rotatable cap 10. The connecting stem 13 is provided at its lower end with an annular groove 14 with which to contact an annular protrusion 25 formed on an inner surface of the upper end 21 of the inner tube 20 (see FIG. 4). By the engagement between the annular groove 14 of the connecting stem 13 and the annular protrusion 25 of the upper end 21 of the inner tube 20, a binding force between the upper rotatable cap 10 and the inner tube 20 is increased, and unwanted radial wobbling of the screw 11 is prevented during rotation of the screw 11.

The glue holder 30 is disposed in the inner tube to shift the solid glue content 1 up and down. The glue holder 30 is formed at its center with a central hole 31. An inner surface of the glue holder 30, which defines the central hole 31, is provided with a threaded groove 31' with which to contact the threaded protrusion 11' of the screw 11, so that a rotational movement of the screw 11 is converted into a linear movement of the glue holder 30.

The glue holder 30 is provided at its outer surface with three linear guide grooves 32. The linear guide grooves 32 of the glue holder 30 are engaged with three linear guide protrusions 26 formed on an inner surface of the inner tube 20 to allow the glue holder 30 to be moved only in upward and downward directions.

The outer tube 40 is coupled to the inner tube 20 at upper ends thereof. Although the outer tube 40 and the inner tube 20 are shown in the drawings to be integrally formed with each other, the outer tube 40 and the inner tube 20 may be coupled to each other by engagement between a retaining groove and a retaining protrusion. The outer tube 40 and the inner tube 20 may be coupled to each other by any coupling way, as long as the gap "A" is defined between a lower part 42 of the outer tube 40 and a lower part 23 of the inner tube 20. The outer tube 40 is formed into a skirt shape such that the outer tube 40 surrounds the inner tube 20 and expands downward. Since an upper end 43 of the outer tube 40 is integrally coupled to an upper end 22 of the inner tube 20, the gap "A" is defined between the outer tube 40 and the inner tube 20, and is closed at an upper end thereof and opened at a lower end thereof. A lower part 42 of the outer tube 40 is provided with four slits 41. The four slits 41 allow a user to easily press the lower part 42 of the outer tube 40 radially inward, in cooperation with the gap "A" defined between the lower part 42 of the outer tube 40 and the lower part 23 of the inner tube 20. Consequently, when a user presses the lower part 42 of the outer tube 40 radially inward, the lower edge of the outer tube 40 pushes the slant face of the upper end 51 of the lower cap 50. Accordingly, the lower cap 50 is separated from the inner tube 20 by a simple operation.

Since the outer tube 40 is constructed such that a diameter of the lower end of the outer tube 40 is larger than a diameter of the upper end, the center of mass of the stick-type glue dispenser according to the present invention is positioned at a lower point, thereby facilitating storage in an erect posture.

The outer tube 40 is provided at its outer surface with a recess 60 to prevent the stick-type glue dispenser from rolling. Therefore, the recess 60 functions to enhance convenience during storage.

As described above, the lower cap 50 includes the slant face on the upper end 51. The upper slant end 51 of the lower cap 50 functions to allow the lower cap 50 to be separated from the inner tube 20 by a pushing force of the outer tube 40 when the outer tube 40 is pressed radially inward by a user.

The lower cap 50 is provided with a retaining groove 52 at an upper portion of an inner surface thereof. The retaining groove 52 is engaged with a retaining protrusion 27 formed at a lower portion of an outer surface of the inner tube 20, thereby enabling the lower cap 50 to be removably fitted on the inner tube 20.

The lower cap 50 includes an outer bottom surface which is flat. Since the outer bottom surface 53 is flat, the outer bottom surface 53 helps to stabilize the stick-type glue dispenser in an erect position, in cooperation with the skirt-shaped outer tube 40, thereby enhancing convenience in storage. In addition, since the upper rotatable cap 10 is formed into a hemispherical shape, the stick-type glue dispenser for dispensing solid glue content according to the present invention can be stored only in an upstanding posture in which the outer bottom surface of the lower cap 50 is in contact with a storing surface such as a working plane of a table, thereby enhancing convenience in storage.

FIGS. 5 and 6 show the stick-type glue dispenser for dispensing solid glue content according to the present invention, which is provided with the mount plate. As shown in FIGS. 5 and 6, the mount plate 54 is threadedly coupled to the outer bottom surface 53 of the lower cap 50. Because use of the mount plate 54 causes the stick-type glue dispenser to be stored only in an erect posture, convenience in storage is enhanced. Accordingly, when the lower cap 50 is separated from the inner tube 20 to use the stick-type glue dispenser, the lower cap 50 remains in place on the mount plate, thereby enhancing convenience in the use. More specifically, since the mount plate 54 maintains the lower cap 50 at the position where the lower cap 50 was separated from the inner tube 20, a user can conveniently couple the inner tube 20 to the lower cap 50 after use.

Although not shown in the drawings, an inner bottom surface of the lower cap 50 is provided with continuous protrusions. The continuous protrusions function to reduce a contact surface area between the sticky solid glue content 1 and the inner bottom surface of the lower cap 50, thereby reducing the adhesive force acting between the solid glue content 1 and the inner bottom surface of the lower cap 50. This allows the lower cap 50 to be more easily separated from the inner tube 20.

Although not apparently shown in the drawings, an outer surface of the inner tube 20 is tapered at a region where the inner tube 20 is fitted in the lower cap 50, and an internal diameter of the lower cap 50 is enlarged upward to correspond to the outer tapered surface of the inner tube 20, so as to reduce the friction between the inner tube 20 and the lower cap 50. Consequently, the lower cap 50 can be relatively easily separated from the inner tube 20, compared to a case in which the inner tube 20 and the lower cap 50 are configured to have purely cylindrical shapes.

An operation of separating the lower cap from the inner tube of the stick-type glue dispenser according to the present invention will be now described with reference to FIGS. 7A and 7B.

FIG. 7A shows the stick-type glue dispenser for dispensing solid glue content according to the present invention, in which the lower cap 50 is coupled to the inner tube 20 during storage, and FIG. 7B shows the stick-type glue dispenser for dispensing solid glue content, in which the lower cap 50 is separated from the inner tube 20 during use. When the lower part 42 of the outer tube 40 is pressed by a user's fingers in the direction of the arrows while the stick-type glue dispenser is gripped in a user's hand, as shown in FIG. 7A, the upper slant end 51 of the lower cap 50 is pushed downward by the lower end of the outer tube 40, thereby allowing the lower cap 50 to be separated from the inner tube 20 in the direction of the arrow shown in FIG. 7B. After the separation of the lower cap 50, the stick-type glue dispenser can be directly used.

The present invention is also directed to a stick-type glue dispenser for dispensing liquid glue content, in which a cap is easily separated from the glue dispenser.

Figure 9:
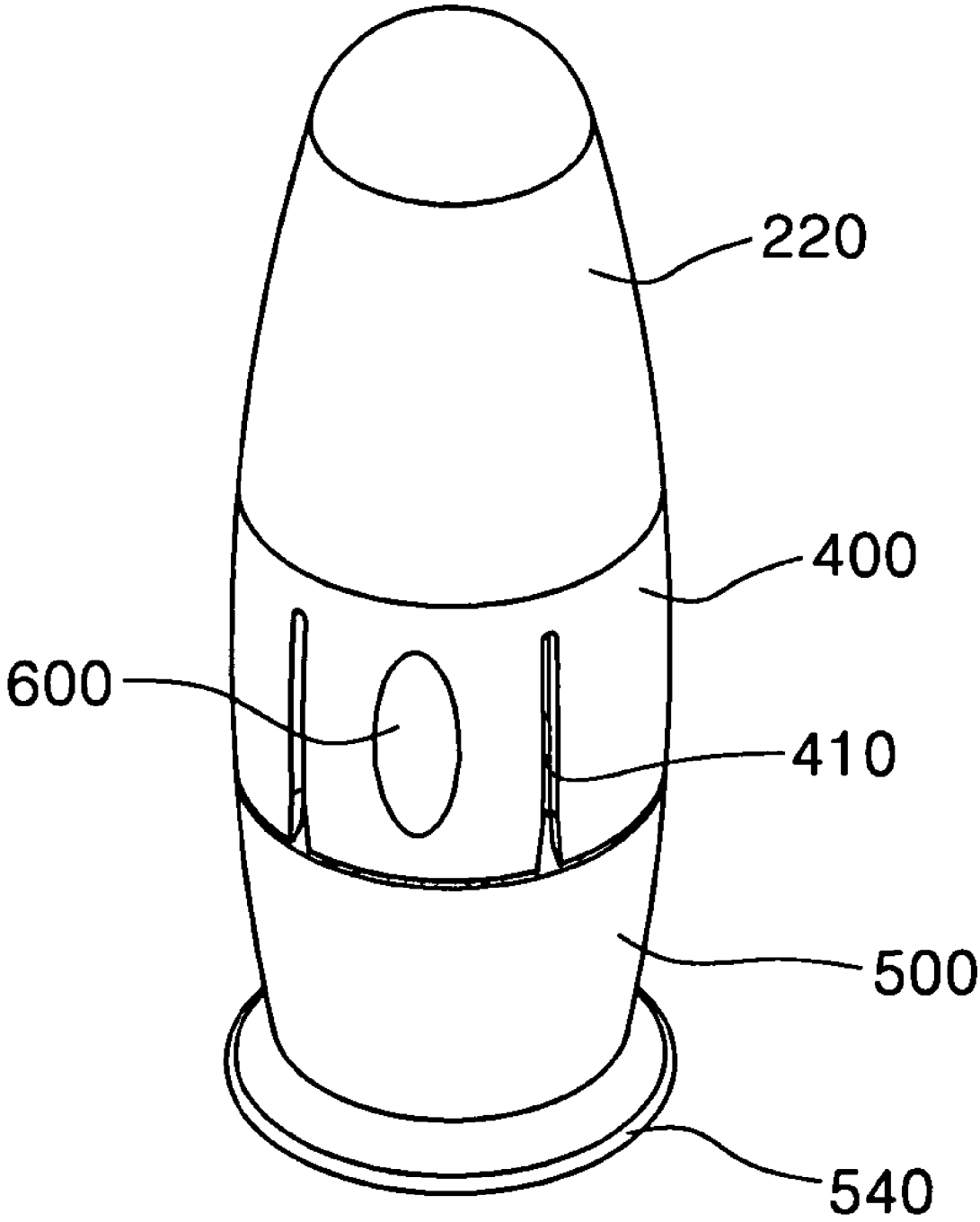
FIG. 9 is a perspective view of the stick-type glue dispenser for dispensing the liquid glue content, according to another embodiment of the present invention.
Figure 10:
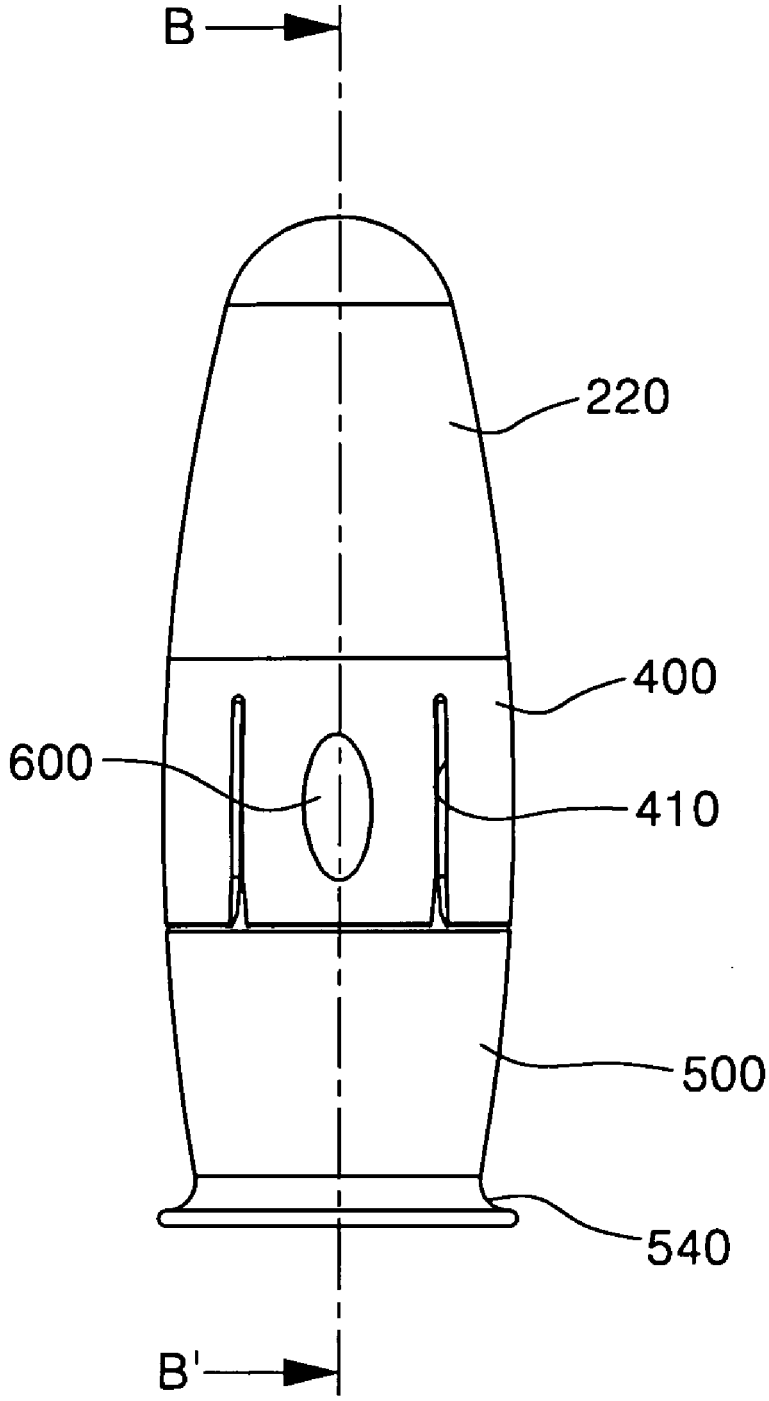
FIG. 10 is an elevation view of the stick-type glue dispenser according to another embodiment of the present invention.
Figure 11:
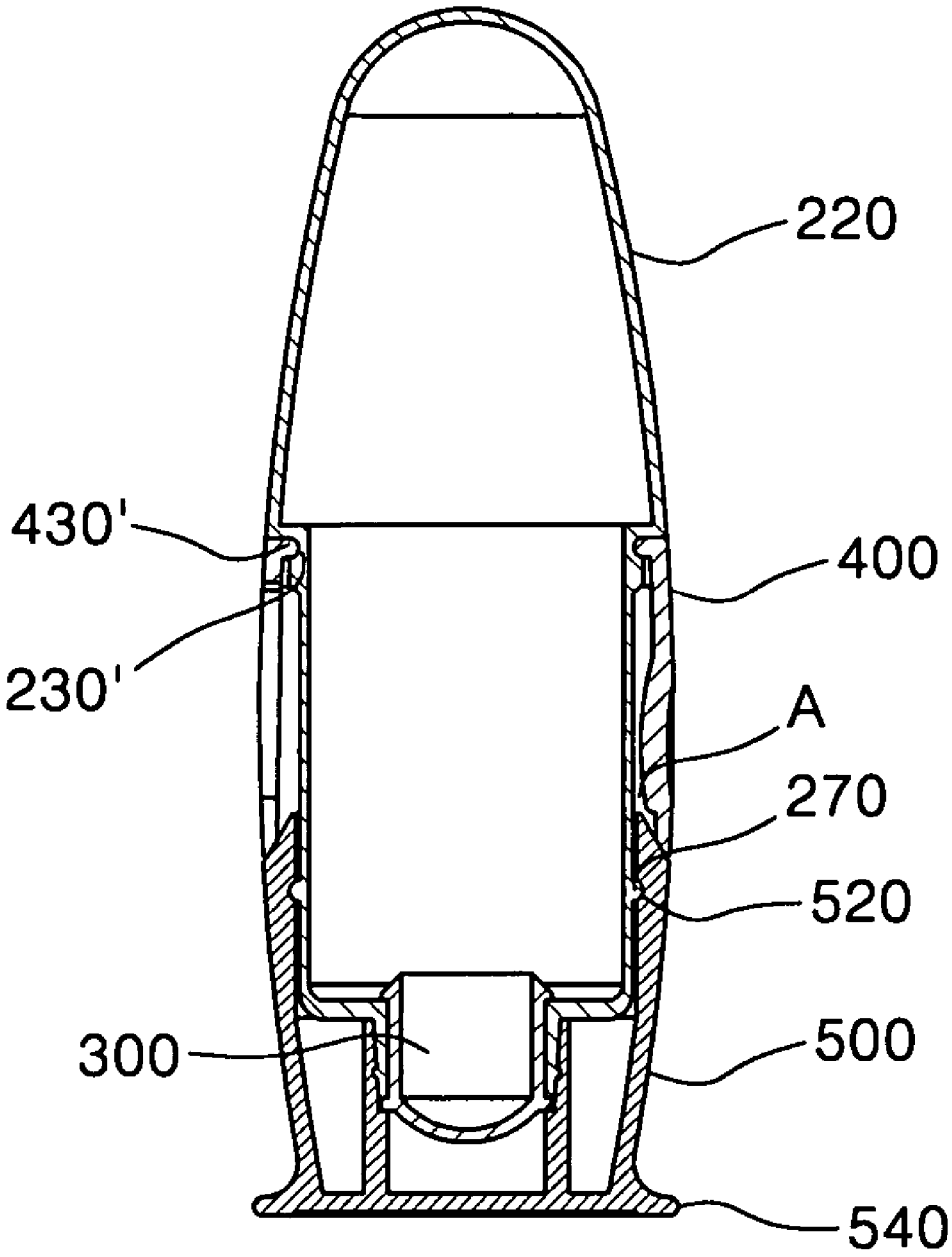
FIG. 11 is a cross-sectional view taken along the line B–B' of FIG. 10.

FIGS. 8 through 11 illustrate the stick-type glue dispenser for dispensing liquid glue content, according to other embodiments of the present invention. In the drawings, FIG. 8A is an exploded perspective view of the stick-type glue dispenser for dispensing liquid glue content, according to another embodiment of the present invention; FIG. 8B is an exploded elevation view of the stick-type glue dispenser for dispensing liquid glue content, according to another embodiment of the present invention; FIG. 9 is a perspective view of the stick-type glue dispenser for dispensing liquid glue content, according to another embodiment of the present invention; FIG. 10 is an elevation view of the stick-type glue dispenser, according to another embodiment of the present invention; and FIG. 11 is a cross-sectional view taken along the line B–B' of FIG. 10.

The stick-type glue dispenser for dispensing liquid glue content, according to another embodiment of the present invention is constructed to have the same configuration as that of the stick-type glue dispenser for dispensing the solid glue content, according to an embodiment of the present invention, with the exception of components intrinsic to the stick-type glue dispenser for dispensing liquid glue content. For example, the stick-type glue dispenser for dispensing liquid glue content, according to another embodiment does not include the upper rotatable cap 10 with the screw 11 and the glue holder 30 of one embodiment of the stick-type glue dispenser for dispensing solid glue content. In contrast to the embodiment of the stick-type glue dispenser for dispensing solid glue content, the stick-type glue dispenser for dispensing liquid glue content, according to another embodiment of the present invention, includes an inner tube 200 which contains liquid glue therein.

Accordingly, even though example embodiments are given with reference to specific configurations, it should be construed that all the descriptions of the stick-type glue dispenser for dispensing solid glue content is applied to the stick-type glue dispenser for dispensing liquid glue content, with the exception of descriptions relating to the components intrinsic to the stick-type glue dispenser for dispensing liquid glue content.

The stick-type glue dispenser for dispensing liquid glue content, according to another embodiment includes an inner tube 200, an outer tube 400 surrounding the inner tube 200 with a gap "A" therebetween and coupled to a middle part 230 of the inner tube 200, and a cap 500 removably coupled to a lower end 240 of the inner tube 200.

The inner tube 200 includes an upper part 220 positioned above the middle part 230, and a lower part 210 positioned below the middle part 230 and inside the outer tube 400. The upper part 220 has a hemispherical shape, and the lower part 210 has a cylindrical shape. The inner tube 200 is made of soft material such as a flexible plastic to allow for an easy release of the liquid glue content.

The lower end 240 of the inner tube 200 is somewhat projected downward. A tip member 300 is fitted to the lower end 240 of the inner tube 200 in such a way that an annular retaining groove 310' formed on an inner surface of an upper end 310 of the tip member 300 is engaged with an annular retaining protrusion 240' formed on an outer surface of the lower end 240. Alternatively, the tip member 300 may be integrally formed with the lower end 240 of the inner tube 200. A lower end 320 of the tip member 300 serves as an outlet for the liquid glue content, and is made of mesh-like material such as sponge. Although not shown in the drawings, the lower end 320 of the tip member 300 may be designed to be retractable. That is, the lower end 320 can be retracted into the tip member 300 when being pushed, and is restored to the normal position when the pushing force ceases. The projection and retraction of the lower end 320 can be achieved by an elastic member provided in the tip member 300. By this configuration, which allows the lower end 320 to be projected and retracted, the liquid glue contained in the inner tube 200 can be easily released.

The outer tube 400, which surrounds the lower part 210 of the inner tube 200, is coupled to the inner tube 200 in such a way that an annular retaining protrusion 430' formed on an inner surface of an upper end 430 of the outer tube 400 is engaged with an annular retaining groove 230' formed on a central part 230 of the inner tube 200. Like the tip member 300, the outer tube 400 may be integrally formed with the inner tube 200. As in the stick-type glue dispenser for dispensing solid glue content, according to one embodiment of the present invention, the outer tube 400 and the inner tube 200 may be coupled to each other by any coupling means so long as the gap "A" is formed between the outer tube 400 and the inner tube 200. The outer tube 400 is provided with four slits 410. The slits 410 enable the cap 500 to be separated from the inner tube 200 in a simple manner, in cooperation with an upper slant end 510 of the cap 500. The outer tube 400 may be provided with a recess 600 to prevent the outer tube 400 from rolling, thereby enhancing convenience in storage.

The cap 500 is coupled to the inner tube 200 in such a way that an annular retaining protrusion 270 formed on the lower part 210 of the inner tube 200 is engaged with an annular retaining groove 520 formed on inner surface of the cap 500. The upper end 510 of the cap 500 has a slant face, and the cap 500 can be separated from the inner tube 200 by pressing the lower end of the outer tube 400 in a simple manner. A mount plate 540 can be attached to or be continuous with an outer bottom surface 530 of the cap 500 to enhance convenience in storage and use.

Although not specifically illustrated in the drawings, the operation of the stick-type glue dispenser for dispensing liquid glue content, according to another embodiment is similar to an embodiment of the stick-type glue dispenser for dispensing solid glue content, as illustrated in FIGS. 7A and 7B.

Although the stick-type glue dispensers for dispensing solid glue content and liquid glue content are commonly made of plastic, ceramic or metal materials, any material suitable for the respective components of the various embodiments of the stick-type glue dispensers may be appropriately selected in consideration of functions of the components. Such a selection may be easily achieved by a person with an ordinary skill in the art.

As described above, the present invention provides a stick-type glue dispenser for dispensing solid or liquid glue content, which is designed to allow a lower cap to be easily separated by a simple operation.

The stick-type glue dispenser according to the present invention has convenience in storage and use.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A stick-type glue dispenser for dispensing a solid glue content, comprising:

(a) a screw;

(b) an upper rotatable cap joined to the screw;

(c) an inner tube detachably coupled at an upper end thereof to the upper rotatable cap;

(d) a glue holder slidably disposed in the inner tube and having a threaded hole with which the screw is engaged, the glue holder being adapted to hold the solid glue content mounted thereon;

(e) an outer tube to surround the inner tube such that a gap is defined between a lower part of the inner tube and a lower part of the outer tube, the gap remaining open at a lower end of each of the inner tube and outer tube; and (f) a lower cap removably coupled to the lower end of the inner tube such that an upper end of the lower cap is positioned in the gap defined between the lower end of the inner tube and the lower end of the outer tube, the upper end of the lower cap having a slant face, wherein the lower cap is separated from the inner tube by a sliding contact between the lower end of the outer tube and the slant face of the lower cap when the lower part of the outer tube is pressed radially inward.

2. The stick-type glue dispenser as set forth in claim 1, wherein the lower part of the outer tube is provided with at least one slit having a predetermined length.

3. The stick-type glue dispenser as set forth in claim 2, having four slits, which are spaced at regular intervals.

4. The stick-type glue dispenser as set forth in claim 1, wherein the outer tube is made of flexible material.

5. The stick-type glue dispenser as set forth in claim 1, wherein a central portion of the outer tube is provided with a flat or recess area having a predetermined size to prevent the stick-type glue dispenser from rolling.

6. The stick-type glue dispenser as set forth in claim 1, wherein the upper rotatable cap has a hemispherical shape; the outer tube gradually enlarges downward such that a diameter of the lower end of the outer tube is larger than a diameter of the upper end of the outer tube; and the lower cap has an outer bottom surface which is flat.

7. The stick-type glue dispenser as set forth in claim 1, wherein the lower cap is provided with a mount plate attached to an outer bottom surface of the lower cap.

8. The stick-type glue dispenser as set forth in claim 1, wherein the lower cap has an inner bottom surface that is provided with convexities or continuous protrusions.

9. The stick-type glue dispenser as set forth in claim 8, wherein the continuous protrusions are concentrically arranged circular protrusions.

10. The stick-type glue dispenser as set forth in claim 1, wherein an outer surface of the inner tube is tapered downward at a region where the inner tube is fitted to the lower cap, and an internal diameter of the lower cap is enlarged upward.

11. A stick-type glue dispenser for dispensing a liquid glue content, comprising:

(a) an inner tube for containing the liquid glue content therein;

(b) a tip member coupled to a lower end of the inner tube to release the liquid glue content;

(c) an outer tube surrounding the inner tube, with a gap defined therebetween; and (d) a lower cap removably coupled to the lower end of the inner tube such that an upper end of the lower cap is positioned in the gap defined between the lower end of the inner tube and a lower end of the outer tube, the upper end of the lower cap having a slant face, wherein the lower cap is separated from the inner tube by a sliding contact between the lower end of the outer tube and the slant face of the lower cap when a lower part of the outer tube is pressed radially inward.

12. The stick-type glue dispenser as set forth in claim 11, wherein the lower part of the outer tube is provided with at least one slit having a predetermined length.

13. The stick-type glue dispenser as set forth in claim 12, having four slits, which are spaced at regular intervals.

14. The stick-type glue dispenser as set forth in claim 11, wherein the outer tube is made of flexible material.

15. The stick-type glue dispenser as set forth in claim 11, wherein a central portion of the outer tube is provided with a flat or recess area having a predetermined size to prevent the stick-type glue dispenser from rolling.

16. The stick-type glue dispenser as set forth in claim 11, wherein an upper part of the inner tube is formed into a hemispherical shape; the outer tube is gradually enlarged downward such that a diameter of the lower end of the outer tube is larger than a diameter of the upper end of the outer tube; and the lower cap has an outer bottom surface which is flat.

17. The stick-type glue dispenser as set forth in claim 11, wherein a mount plate is attached to an outer bottom surface of the lower cap.

18. The stick-type glue dispenser as set forth in claim 11, wherein convexities or continuous protrusions are provided at an inner bottom surface of the lower cap.

19. The stick-type glue dispenser as set forth in claim 18, wherein the continuous protrusions are concentrically arranged circular protrusions.

20. The stick-type glue dispenser as set forth in claim 11, wherein an outer surface of the inner tube is tapered downward at a region where the inner tube is fitted to the lower cap, and an internal diameter of the lower cap is enlarged upward.

21. The stick-type glue dispenser as set forth in claim 11, wherein the inner tube is made of flexible material.

22. The stick-type glue dispenser as set forth in claim 11, wherein the tip member includes a lower end serving as an outlet for the liquid glue content contained in the inner tube, the lower end of the tip member being projectable and retractable by an elastic force.

* * * * *